US005974153A

United States Patent [19]

Cashion et al.

[11] Patent Number: 5,974,153

[45] Date of Patent: Oct. 26, 1999

[54] METHOD AND SYSTEM FOR SOUND EXPANSION

[75] Inventors: Terry K. Cashion; Simon Williams; John Arthur; Mark Williams, all of Alberta, Canada

[73] Assignee: QSound Labs, Inc., Alberta, Canada

[21] Appl. No.: 08/858,594

[22] Filed: May 19, 1997

[51] Int. Cl.[6] ..... H04H 5/00; H04R 5/00

[52] U.S. Cl. ..... 381/11; 381/1; 381/12; 381/17

[58] Field of Search ..... 381/1, 11–12, 381/17–23, 63, 97

[56] References Cited

U.S. PATENT DOCUMENTS

| | | | |
|---|---|---|---|
| 4,817,162 | 3/1989 | Kihara | 381/1 |
| 4,868,878 | 9/1989 | Kunugi et al. | 381/1 |
| 4,908,858 | 3/1990 | Ohno | 381/1 |
| 4,980,914 | 12/1990 | Kunugi et al. | 381/1 |
| 5,046,097 | 9/1991 | Lowe et al | 381/17 |
| 5,095,507 | 3/1992 | Lowe | 381/17 |
| 5,109,415 | 4/1992 | Ishida | 381/1 |
| 5,119,420 | 6/1992 | Kato et al. | 381/1 |
| 5,138,660 | 8/1992 | Lowe et al. | 381/17 |
| 5,434,921 | 7/1995 | Dombrowski, Jr. et al. | 381/1 |
| 5,774,556 | 6/1998 | Lowe et al. | 381/17 |

FOREIGN PATENT DOCUMENTS

| | | | |
|---|---|---|---|
| 0412725 | 2/1991 | European Pat. Off. | 381/17 |
| 53-38301 | 4/1978 | Japan | 381/17 |
| 53-137102 | 11/1978 | Japan | 381/17 |
| 58-190199 | 11/1983 | Japan | 381/17 |
| 59-114999 | 7/1984 | Japan | 381/1 |
| 59-147597 | 8/1984 | Japan | 381/1 |

*Primary Examiner*—Forester W. Isen
*Assistant Examiner*—Xu Mei
*Attorney, Agent, or Firm*—Fulbright & Jaworski L.L.P.

[57] ABSTRACT

Monaural inputs are accepted for presentation to a pair of speakers. The output sound image from that pair of speakers is such that a listener will perceive that the sound is stereo and that certain sounds come from a non-existent center speaker and that other sounds come from locations beyond the physical boundaries of the two speakers. The system operates to preserve full tone range at both speakers and does not split the sound from a particular instrument between both speakers. The system can be used to provide sound signals to the rear speakers of a multiple speaker system when the sound input to the rear speakers is either monaural or stereo.

15 Claims, 3 Drawing Sheets

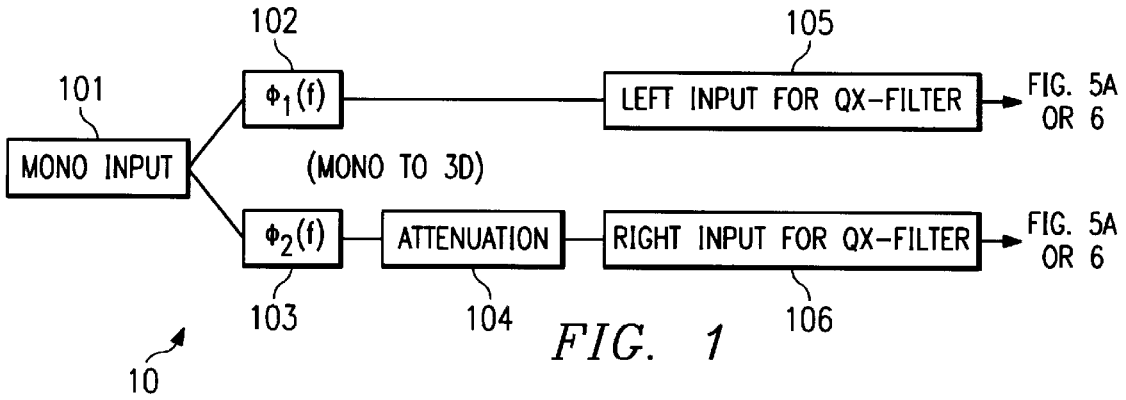
FIG. 1
$|\phi_1(f)-\phi_2(f)|=60°$ (WITH A TOLERANCE OF ±5°, FOR THE MINIMUM RANGE $100Hz \leq f \leq 10kHz$)
FIG. 2
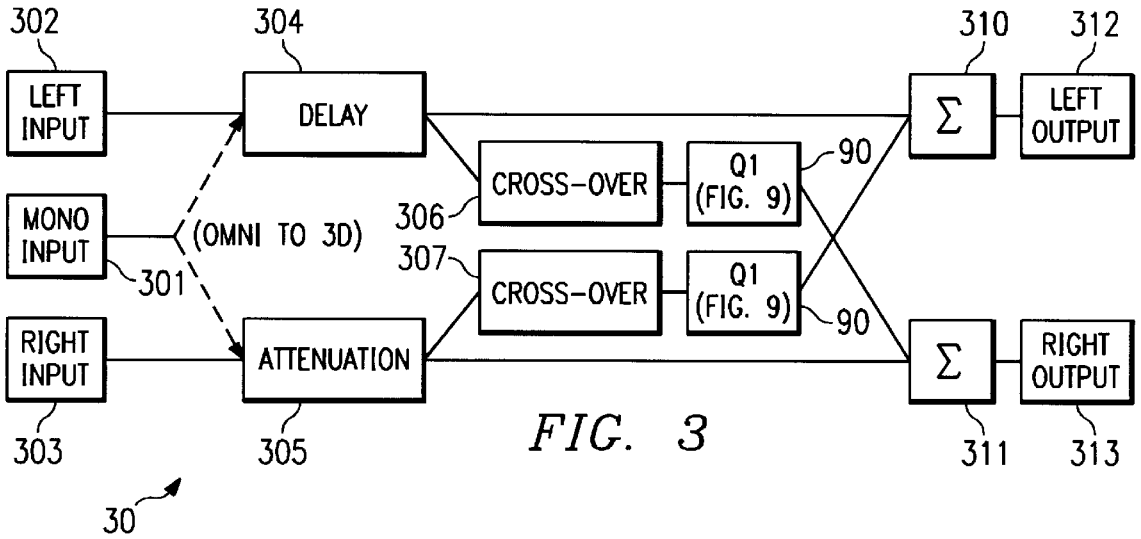
FIG. 3
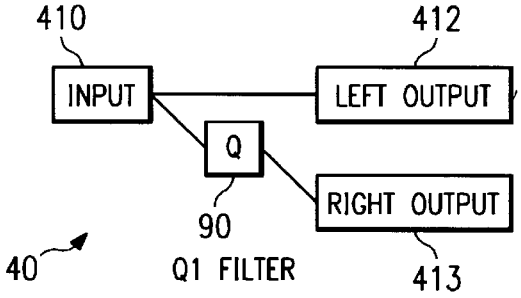
FIG. 4A
(PRIOR ART)

METHOD AND SYSTEM FOR SOUND EXPANSION

RELATED APPLICATION

Reference is hereby made to commonly assigned and co-pending U.S. patent application FULL SOUND ENHANCEMENT USING MULTI-INPUT SOUND SIGNALS, U.S. Ser. No. 08/858,586, filed concurrently herewith and copending U.S. patent application STEREO ENHANCEMENT SYSTEM INCLUDING SOUND LOCALIZATION SYSTEM, U.S. Ser. No. 08/511,788, filed Aug. 7, 1995, which applications are incorporated herein by reference.

BACKGROUND OF THE INVENTION

1. Technical Field of the Invention

This invention relates to a system and method for expanding sound. More particularly, the invention relates to a system that expands sound images from monaural inputs and/or stereo inputs for presentation to left and right output transducers without loss of information content and without altering the tone or stereo balance while maintaining speech centered in the resultant sound image.

2. Description of Related Art

It is now well known that sound images that would normally be directed to two speakers can be manipulated so that the resulting sound output, as perceived by a listener positioned in front of the speakers, will appear to that listener as coming from a location other than from the physical location of the speaker sets, including locations to the left of the left loudspeaker and to the right of the right loudspeaker.

U.S. Pat. Nos. 5,105,462 and 5,208,860, issued to Lowe, et al. on Apr. 14, 1992, and May 4, 1993, respectively, which patents are hereby incorporated by reference herein, are illustrations of systems for positioning monaural sound images at any desired location around a listener. The Lowe patents take a monaural sound image input and position that sound image at a selected location. The systems discussed in the '462 and '860 patents are herein referred to as the Q1 system.

FIG. 4A is an illustration of a filter based upon the disclosure contained in the '462 and '860 patents. The Q1 filter 40 of FIG. 4A will produce a left virtual image. Q1 filter 40 is comprised of an input for a sound signal 410, circuitry for adjusting the phase and amplitude of the input signal 90, and outputs for the altered signal 413 and the unaltered input signal 412.

FIG. 4B illustrates the effect of positioning of a monaural input signal as is accomplished, for example, by the systems disclosed in the '462 and '860 patents. When a monaural input signal is positioned, a listener 453 located in front of a pair of transducers 450, 451 will perceive the sound as coming from a location 452 other than from the physical location of the speakers.

U.S. Pat. No. 5,440,638, issued to Lowe, et al. on Aug. 8, 1995, which patent is hereby incorporated herein by reference, shows a system for enhancing the stereo sound image by removing the common audio information and adding that common information back so that it is preserved in the output sound image heard by the listener. The system described in the '638 patent is referred to as the QX process.

For example, FIG. 5B illustrates the effect of expansion of a stereo input signal. When a stereo input signal is expanded, a listener 553 Apositioned in front of a pair of transducers 550, 551 will perceive an expanded sound field 552 extending beyond the location of the transducers.

Copending U.S. patent application Ser. No. 08/511,788, filed Aug. 7, 1995, discloses a system for enhancing stereo sound images by removing at least a portion of common audio information. An embodiment of the system described in the copending application is shown in FIG. 5A. The systems described in this copending application are also referred to as QX processes.

Prior art sound expansion systems utilize differences between two input signals to expand the input sound. When two input signals are the same, as in a monaural input signal, there is no significant difference between the two input signals for prior art systems to utilize for expansion purposes. Thus, prior art sound expansion systems cannot satisfactorily expand monaural input signals.

Another major problem when attempting to expand sound from a monaural source is that the resultant sound image must sound "real" and not be overly colored.

Thus, an object of this invention is to give a listener the perception that he/she is hearing stereo sound with a full range of highs and lows spread throughout the hearing pattern when the input signals are monaural.

It is further desired to produce a distributed hearing pattern such that the sound image does not appear to come from any one single position.

A further problem in the prior art when attempting to convert monaural sound signals to pseudo stereo is that certain sounds, such as speech, should appear to come from the center as opposed to from one side. Also, in some situations, the character of an input signal will alternate from monaural to true stereo.

Therefore, it is desired to design a system which can accept such an input without changing the position of various instruments when the character of the input is stereo. For example, if the sounds from the horns arrive on the right input, the system should not change the relative position of the horns within the listening field. Further, the system should not split the horn sounds so that part of the sound range comes from the right speaker and part of the sound range comes from the left speaker.

Thus, there is a need in the art for a system and method for accepting a monaural sound image and for creating from that sound image a stereo sound image available for presentation to left and right transducers without coloring the sound output.

A further need exists for such a system that can work on either digital and analog input signals.

A still further need exists in the art for such a system which can accept both monaural as well as stereo inputs without affecting the stereo output image.

SUMMARY OF THE INVENTION

These and other objects and features of our invention are achieved by a system and method whereby in a first embodiment the input from a monaural source is separated into two input sources, or channels, each being identical to the other. In a preferred embodiment, a relative phase shift of 60° is introduced between the channels for frequencies within the audio spectrum. However, relative phase shifts from about 30° to about 125° will also effectuate the purpose of the invention. The relative phase shift should be constant across the frequencies in the audio spectrum with a deviation no greater than ±5°.

The phase shift can be achieved in one channel only or can be distributed between both channels. When using the dual phase shift approach, the phase-shift can be different at different frequencies provided the phase difference between the channels remains at approximately 60°.

After achieving the phase shift discussed above, the channel with the leading phase must be attenuated so as to give both channels an equal apparent loudness to maintain an image centered between the two speakers. The two channels are then supplied to a QX filter. The preferred attenuation is 2 db. An advantage of this circuit is that it may be implemented whether the input signal is digital or analog.

In an alternative form of the first embodiment in which a single Q1 filter is used, attenuation of the channel with the leading phase is unnecessary.

In some situations it is desired to have a system that will handle inputs which can be either monaural or stereo. In this situation an alternative embodiment can be used in which the input, when monaural, it is first divided into two equal inputs. When the input is stereo, two inputs already exist and are handled in the same manner as the split monaural input.

One of the inputs is delayed a certain amount while the other input is attenuated a certain amount. The delayed signals and the attenuated signal are then each passed through crossover circuits which are designed to pass frequencies over 110 Hz. The outputs of the crossover circuits are then presented as inputs to a pair of Q1 filters as described in the commonly owned U.S. Pat. Nos. 5,105,462 and 5,208,860. Each "crossover" signal is then mixed with the signal from the other channel to form the output.

Accordingly, one technical advantage of this alternative embodiment and method is that it provides balanced stereo output signals from either monaural or stereo input signals and can be used for both analog and digital sound signal inputs.

A further technical advantage is that this invention can be implemented by a digital processor, analog circuit elements, or analog IC.

The foregoing has outlined rather broadly the features and technical advantages of the present invention so that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 shows one alternative embodiment of our invention where the input is monaural;

FIG. 2 shows the constraints imposed on the phase functions of FIG. 1;

FIG. 3 shows an alternative embodiment of our invention in which the input can be either monaural or stereo;

FIGS. 4A and 4B show a prior art Q1 filter for producing a left image and its resulting sound image;

DESCRIPTION OF THE PREFERRED EMBODIMENTS

1. $1_2$3D SYSTEMS

Figure 4B:
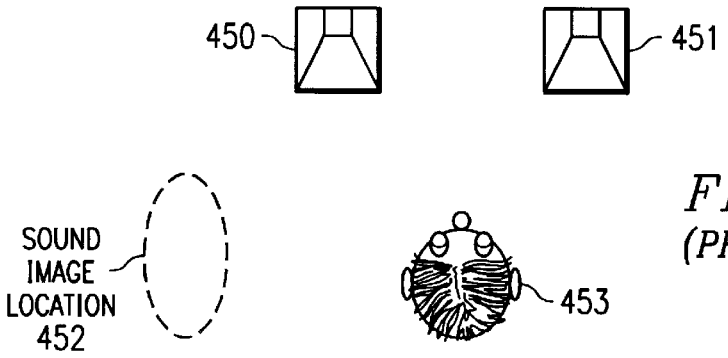
FIG. 4B (PRIOR ART)

FIG. 1 illustrates a circuit 10, one embodiment of the invention, and which is particularly useful for analog implementations.

Circuit 10 accepts a monaural signal at 101 and splits the signal into two equal signals which become inputs to phase modification boxes 102 and 103, respectively. The phase shift function of the left channel is shown as $\Phi_1(f)$ and for the right channel is $\Phi_2(f)$. The shape of these two phase altering functions is relatively unimportant provided the two functions obey the constraints shown in FIG. 2 where the difference between the two phase shifting functions equals 60° over a frequency range covering at least 100 Hz to 10 KHz. Preferably, this difference will have a tolerance of plus or minus 5°. In addition, the channel whose phase leads the other channel (the right channel in FIG. 1) is required to have attenuation as shown in box 104, preferably 2 dB, so as to give both output channels an equal average apparent loudness level to the listener.

Figure 5A:
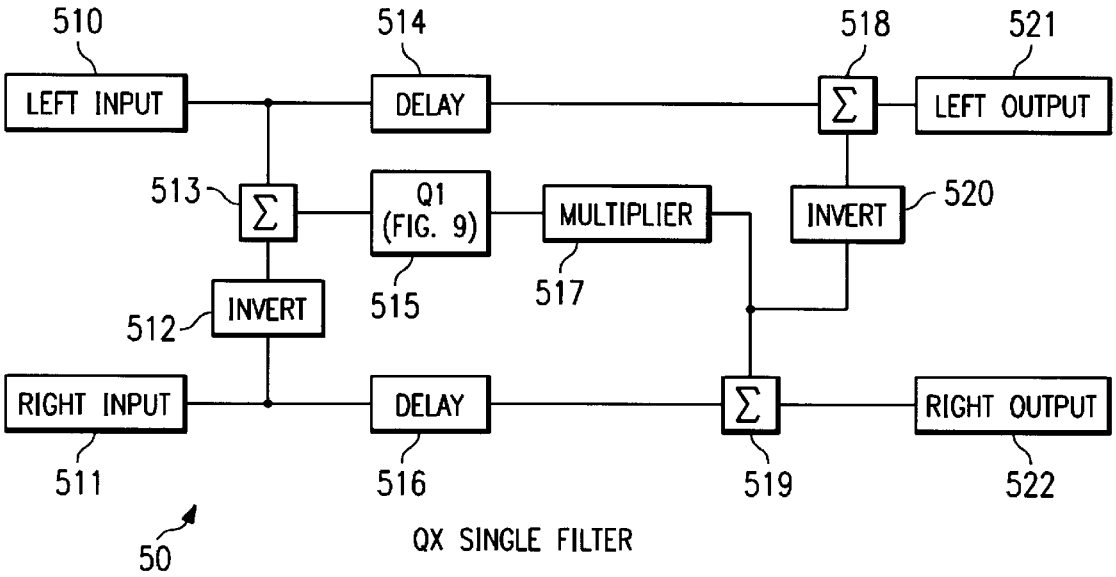
FIGS. 5A and 5B show the prior art QX filter and its resulting sound image.
Figure 5B:
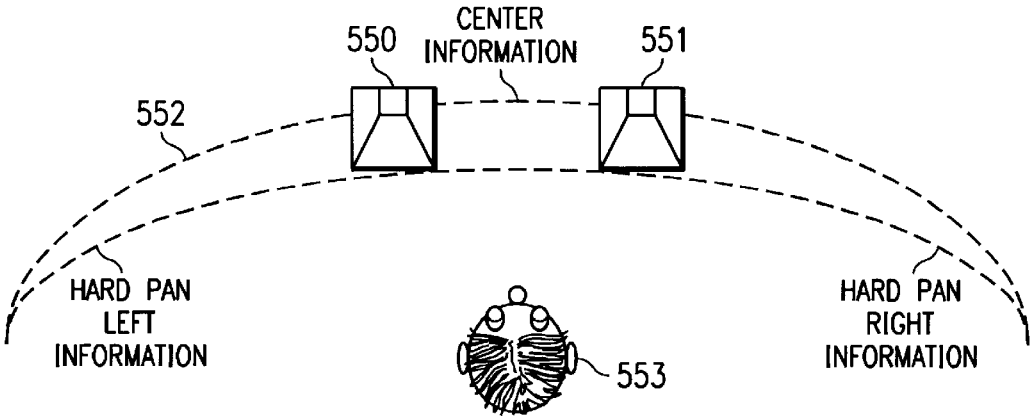
Figure 6:
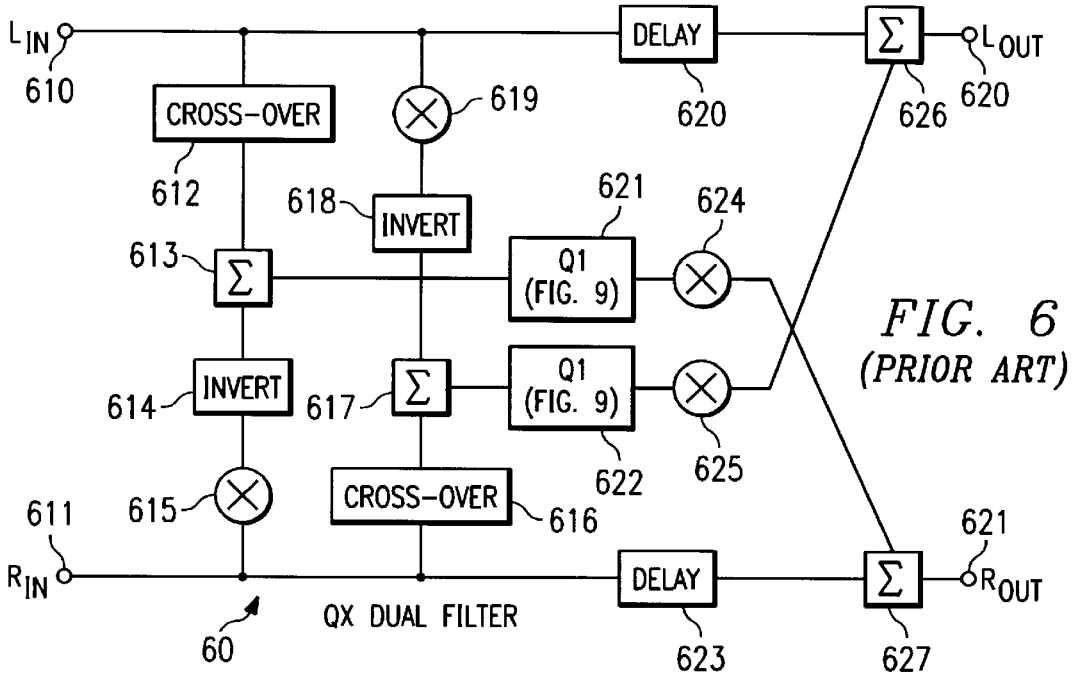
FIG. 6 (PRIOR ART)
FIG. 6 shows an alternate embodiment of the prior art QX filter.

As shown in FIG. 1, the output of phase shift 102 is provided as the left input 105 for a QX processor, alternative embodiments of which are shown in FIG. 5A and FIG. 6. The output of attenuation 104 is provided as the right input 106 to the same QX filter as the above.

In the embodiment of the $1_2$3D system utilizing the QX filter 50 of FIG. 5A, the output 105 of phase shift 102 is provided as the left input 510 of the QX filter. The output 106 of attenuation 104 is provided as the right input 511 of the QX filter. The left input 510 is split into two paths with one path leading to a delay device 514 and the other path leading to a summation circuit 513. Meanwhile, the right input 511 is also split into two paths with one path input to an invertor 512 and the other path leading to a delay device 516. The output of invertor 512 is also input to the summation circuit 513.

The output of the summation circuit 513 is then input to a Q1 filter 515 which effectuates a phase delay and amplitude adjustment to the signal. The adjusted signal is input to a multiplier 517 which controls the width of the expansion. The output of the multiplier 517 is then combined with the output of delay 516 in a summation circuit 519 to produce an enhanced right output 522. The output of multiplier 517 is also inverted in an invertor 520 and combined with the output of delay 514 in a summation circuit 518 to produce an enhanced left output 521.

Alternatively, in the embodiment of the $1_2$3D system utilizing the QX filter 60 of FIG. 6, the output 105 of phase shift 102 is provided as the left input 610 of the QX filter. The output 106 of attenuation 104 is provided as the right input 611 of the QX filter. The left input 610 is then input to a cross-over circuit 612, an attenuator 619, and a delay device 620. The output of attenuator 619 is subsequently passed through an invertor 618. The right input 611 is also input to an attenuator 615, a cross-over circuit 616, and a delay device 623. The output of attenuator 615 is also subsequently passed through an invertor 614.

The output of cross-over circuit 612 and the output of invertor 614 are input to summation circuit 613 to produce a difference signal in which at least a portion of information common to both input signals is removed. The output of summation circuit 613 is then input to a Q1 filter 621 which effectuates a phase delay and amplitude adjustment to the signal. The adjusted signal is the input to an attenuator 624 which controls the width of the expansion. The attenuated signal is then combined with the output of delay device 623 in a summation circuit 627 to produce an enhanced right output 621.

Meanwhile, the output of cross over circuit 616 and invertor 618 are input to a summation circuit 617 to produce a difference signal in which at least a portion of information common to both input signals is removed. The output of summation circuit 617 is then input to a Q1 filter 622 which effectuates a phase delay and amplitude adjustment to the signal. The adjusted signal is then input to an attenuator 625 which controls the width of the expansion. The attenuated signal is then combined with the output of delay device 620 in a summation circuit 626 to produce an enhanced left output 620.

2. OMNI$_2$3D SYSTEM

FIG. 3 shows an alternate embodiment 30 in which the input may be either a monaural 301 or stereo input 302, 303. If the input is monaural, the monaural signal 301 is split into two equal signals which are input to delay device 304 and attenuator 305. If, on the other hand, the input signal is stereo, the left and right channels 302, 303 are supplied and input to delay device 304 and attenuator 305, respectively. This embodiment is particularly useful in situations where the character of the input signal provided on two channels is dynamic, i.e., alternates between stereo and mono. This embodiment is also useful in situations in which the same circuit must be used with both stereo and monaural inputs.

In a preferred embodiment, the delay effectuated by delay device 304 is typically 0.5 ms while the attenuation effectuated by attenuator 305 is typically 3 dB. Attenuation is necessary to prevent the apparent image of the sound from being shifted to the right speaker because of the delay in the left input 302. The signals are then passed through a pair of modified Q1 filters 90. The modified Q1 filters, comprised of elements 306, 307, 90, contribute to the expansion of the sound image.

Figure 10:
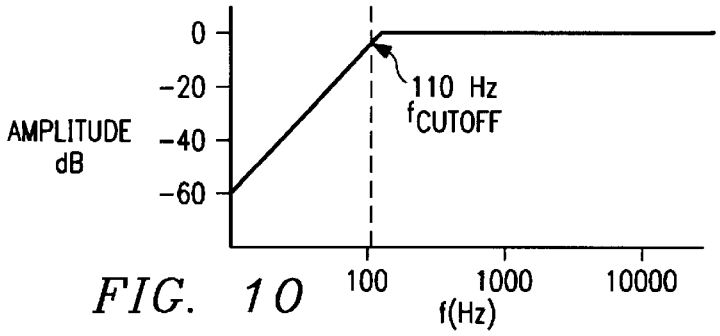
FIG. 10 shows the cutoff v. frequency graph of a typical crossover circuit.

Crossovers 306, 307 (shown in FIG. 10) are designed so that they pass only those frequencies above 110 Hz and attenuate frequencies below that frequency, as shown in FIG. 10. The processed crossover signals then are summed by summers 310 and 311 with the opposite sides' inputs to produce enhanced left and right outputs 312, 313.

Figure 9:
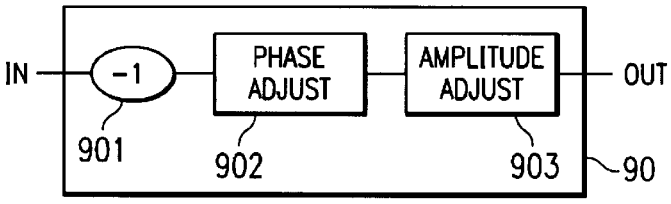
FIG. 9 shows the processing portion of a typical Q1 circuit.

Q1 filter 90, as shown in FIG. 9, serves to invert the input signal via box 901, phase adjust the signal via box 902 and amplitude adjust the signal via box 903. These phase and amplitude adjustments are frequency dependent as detailed in the above-identified U.S. Pat. Nos. 5,105,462 and 5,208,860.

The choice of delay length via 304 serves to cause the human voice to appear to come from between the speakers, where the center speaker would normally be. This is true for both male and female voices which tend to remain centered, while other frequencies, such as caused by musical instruments, tend to be expanded to the left and right.

Circuit 30 of FIG. 3 is particularly useful in digital implementations. As discussed above, circuit 30 is also useful when the input signal may be either monaural or stereo because the relative position of sounds in the stereo image is maintained by this circuit.

Figure 7:
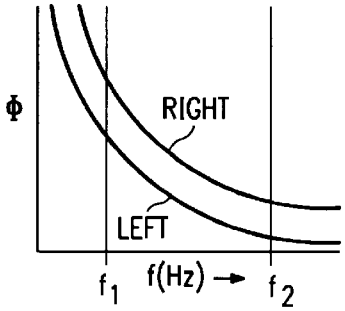
FIG. 7 shows phase as a function of frequency for the circuit of FIG. 1.

FIG. 7 shows the phase responses as a function of frequency of the phase shifting elements of circuit 10 shown in FIG. 1 showing that the phase shift can have a different absolute value frequency. At all frequencies both the left and the right phase adjustments are separated by approximately 60°.

Figure 8A:
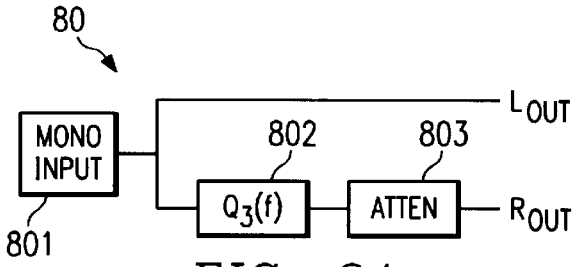
FIGS. 8A & 8B show an alternative to the circuit of FIG. 1 together with its phase v. frequency graph.
Figure 8B:
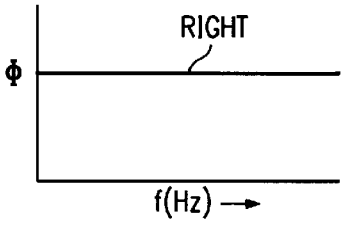

FIG. 8A is an alternate version of FIG. 1, where circuit 80 shows a mono input 801 with all of the phase adjustment in a single phase shift circuit 802 represented by $\Phi_3(f)$. This phase shift is approximately 60° with respect to the input signal, but is constant over the entire frequency as shown in FIG. 8B, thereby complying with the formula set forth in FIG. 2. The output of the single phase shift circuit 802 is then passed through an attenuator 803. Attenuation of the output of phase shift circuit 802 results in outputs with an equal average apparent loudness level to the listener.

Although the present invention and its advantages have been described in detail, it should be understood that various changes, substitutions and alterations can be made herein without departing from the spirit and scope of the invention as defined by the appended claims. For example, the system and method described could be used to provide full stereo sound from the rear two speakers of a five speaker+system where the input to the rear speakers is monaural. The system will function when the character of the input is unknown, the character being either monaural or stereo. Thus, an advantage of this invention is that it does not require different systems for different signal types. Another advantage of the invention is that it does not require a determination of whether the input signal is monaural or stereo.

What is claimed is:

1. A circuit for converting either a monaural or stereo input sound signal to an expanded stereo output signal, said circuit comprising:

means for accepting two input signals;

means for delaying a first one of said input signals with respect to the second one of said input signals;

means for attenuating said second input signal with respect to said first input signal;

means for creating from the delayed first input signal and from the attenuated second input two independent crossover signals having frequencies only above approximately 110 Hz;

means for passing each of said crossover signals through respective Q1 filters to create an output signal;

means for summing the output of the Q1 filter which is associated with the attenuated second input signal with the delayed first input signal to create a first output signal; and means for summing the output of the Q1 filter which is associated with the delayed first input signal with the attenuated second input to create a second output signal, said first and second outputs operable for driving spaced apart transducers to create an expanded stereo sound image signal of the input sound signal.

2. The circuit as set forth in claim 1, further including:

means for splitting a monaural input signal to two equal input signals for presenting to said accepting means.

3. The circuit as set forth in claim 1, wherein said Q1 filter passing means includes:

means for inverting the input signal;

means for phase adjusting the inverted signal; and means for amplitude adjusting the phase adjusted signal.

4. The circuit as set forth in claim 3, wherein said phase adjusting means includes:

means for adjusting the phase on a frequency dependent basis; and wherein said amplitude adjusting means includes:

means for adjusting the amplitude on a frequency dependent basis.

5. The circuit as set forth in claim 1, wherein said attenuation provides an equal average loudness to a listener of sound from said transducers.

6. The circuit as set forth in claim 5, wherein said attenuation is within the approximate range of 0 dB to 6 dB.

7. The circuit as set forth in claim 1, wherein said attenuation is sufficient to provide a sound image that is front centered for a listener.

8. A method for converting either a monaural or stereo input sound signal to an expanded stereo output signal, said method comprising the steps of:

accepting two input signals;

delaying a first one of said input signals with respect to the second one of said input signals a certain amount;

attenuating said second input signal with respect to said first input signal;

creating from the delayed first input signal and from the attenuated second input two independent crossover signals having frequencies only above approximately 110 Hz;

passing each of said crossover signals through respective Q1 filters to create an output signal only frequencies above approximately 110 Hz;

summing the output of the Q1 filter which is associated with the attenuated second input signal with the delayed first input to create a first output signal; and summing the output of the Q1 filter which is associated with the delayed first input signal with the attenuated second input signal to create a second output signal, said first and second output signals forming input signals for respective left and right sound transducers.

9. The method of claim 8, further comprising the step of:

splitting a monaural input signal to two equal input signals for acceptance in said accepting step.

10. The method of claim 8, wherein said passing step comprises the steps of:

inverting each of said crossover signals;

phase adjusting each of said inverted signals; and amplitude adjusting each of said phase adjusted signals.

11. The method of claim 10, wherein said phase adjusting step comprises the step of:

adjusting the phase on a frequency dependent basis; and wherein said amplitude adjusting step comprises the step of:

adjusting the amplitude on a frequency dependent basis.

12. A method for creating a stereo sound image for a listener positioned with respect to first and second sound transducers from a monaural input, said method comprising the steps of:

accepting a sound input signal on two inputs;

delaying the input signal at a first one of said inputs;

attenuating the input signal at the second one of said inputs;

modifying each of said attenuated and delayed input signals by removing therefrom all frequencies below a cutoff frequency;

providing said modified signals to the respective inputs of Q1 filters;

summing the output of the Q1 filter which is associated with the attenuated second input signal with the delayed signal at said first input to provide a first output signal for presentation to the first sound transducer; and summing the output of the Q1 filter which is associated with the delayed first input signal with the attenuated signal at said second input to provide a second output signal for presentation to the second sound transducer.

13. The method as set forth in claim 12, wherein said cutoff frequency is 110 Hz.

14. The method as set forth in claim 13, wherein said Q1 filters invert, phase adjust and amplitude adjust the presented signals on a frequency dependent basis.

15. The method as set forth in claim 14, wherein said phase adjustment is different for different frequencies.

* * * * *